United States Patent [19]

Dummer

[11] 4,109,733

[45] Aug. 29, 1978

[54] TILT PREVENTING SYSTEM FOR DRILLS

[75] Inventor: Robert E. Dummer, Milwaukee, Wis.

[73] Assignee: Bucyrus-Erie Company, South Milwaukee, Wis.

[21] Appl. No.: 828,746

[22] Filed: Aug. 29, 1977

[51] Int. Cl.[2] ..... B23Q 5/027; E21C 11/02

[52] U.S. Cl. ..... 173/4; 173/23; 173/37

[58] Field of Search ..... 91/1; 173/4, 8, 20, 173/23, 37; 175/27; 180/41; 248/188.3; 280/763, 766; 299/1

[56] References Cited

U.S. PATENT DOCUMENTS

| | | | |
|---|---|---|---|
| 2,003,078 | 5/1935 | Hild | 173/4 X |
| 2,711,880 | 6/1955 | McKenzie | 173/4 |
| 3,587,392 | 6/1971 | Edwards | 91/1 |
| 3,648,783 | 3/1972 | Lackey | 173/4 |
| 3,659,655 | 5/1972 | Gyongyosi | 173/4 X |
| 3,721,305 | 3/1973 | Mayer et al. | 173/20 |
| 3,734,202 | 5/1973 | Gyongyosi | 173/4 |
| 3,834,731 | 9/1974 | Uehara | 280/766 |
| 4,007,847 | 2/1977 | Marco | 280/766 X |

FOREIGN PATENT DOCUMENTS

| | | | |
|---|---|---|---|
| 2,407,717 | 8/1975 | Fed. Rep. of Germany | 91/1 |
| 306,258 | 3/1972 | U.S.S.R. | 173/20 |

*Primary Examiner*—Lawrence J. Staab
*Attorney, Agent, or Firm*—Quarles & Brady

[57] ABSTRACT

A control is disclosed for inhibiting the tilting of an earth drilling machine that is supported on hydraulic jacks. A hydraulic downfeed motor for the drill string is operated by a control that has pressure responsive switches connected to the hydraulic jacks, and in the event the drilling machine starts to rise upwardly during drilling one of the pressure responsive switches will operate to shut off fluid pressure to the downfeed motor and to entrap fluid within the motor. The entrapment of fluid in the motor maintains a drilling pressure that permits drilling to continue with a drilling force that will not allow the machine to rise upwardly on the supporting jacks.

5 Claims, 2 Drawing Figures

TILT PREVENTING SYSTEM FOR DRILLS

BACKGROUND OF THE INVENTION (a) Field of the Invention

This invention relates to earth drilling machines such as blast hole and water well drills.

(b) Description of the Prior Art

Earth drilling machines commonly deliver drilling force to the drill string through a motor that drives a drilling head, mounting the drill string and an associated rotary drive, downwardly along a vertical mast. If the drill encounters hard rock that arrests penetration the upward reaction force upon the machine can reach the full, available downward force that may be applied to the drilling head. For some machines this upward reaction force can exceed the weight of the machine, and consequently the machine will rise upward with a resultant decrease in machine stability. The loss of stability imposes a danger to both the machine and its operator.

To alleviate the problem of an unstable condition, the maximum downward drilling force can be limited, but this results in a loss of efficiency in the drilling apparatus. An approach to maintaining a near maximum drilling force is shown in U.S. Pat. No. 3,734,202 issued May 22, 1973 for an "Automatic Feed Control System". There, a physical rise, or lift of the drilling machine is sensed by a motion responsive switch, and pressurized fluid being delivered to a downfeed motor is then partially, or fully shunted from the motor until the machine settles back down on its supporting jacks. Thus, an actual upward motion of the machine that could decrease stability must occur as a condition precedent to limiting the downfeed force. It would be superior to automatically limit the increase in downfeed drilling force before any rise of the machine occurs, and the present invention is directed to this objective.

SUMMARY OF THE INVENTION

The invention can be summarized as residing in a tilt inhibiting control for a drilling machine supported, at least in part, on hydraulic jacks and having a hydraulic downfeed motor for generating drilling pressure, such control including a feed control valve for the downfeed motor, a pilot oil line for the feed control valve, an overload valve in the pilot oil line that can drain oil from the pilot oil line, and pressure responsive switches connected to the hydraulic jacks that monitor the pressure therein, such switches operating said overload valve to drain pilot oil upon a change of pressure occurring in a supporting jack that is indicative of a drilling force that could raise the machine.

It is desirable to apply drilling forces that will provide a maximum rate of penetration into the earth. Except for very large drilling machines, the downward drilling force deliverable by a machine can often become as large as the weight of the machine itself. Particularly, when the drill is arrested in its penetration by hard rock, or when the drill string becomes mired in the hole, the build-up of downward force exerted by the downfeed motor can rise to values that cause the machine to actually climb up the drill string. This causes the machine to unseat itself from the supporting jacks on which it rests during drilling. The present invention is intended to limit the drilling force, so that the machine will not rise and create an unstable condition. The invention is also intended to automatically maintain a drilling force, rather than to sharply decrease it, or to cut it out altogether when the machine starts to rise upwardly.

To maintain a drilling force, the hydraulic downfeed motor is disconnected, or cut-off from the source of fluid pressure which normally drives it. The motor is disconnected from the fluid pressure line in such a manner that fluid is entrapped within the motor, so that it may not drain to the reservoir. The motor then becomes a rigid member that retains the drill against the hole bottom. The weight of the machine may then be transmitted to the drill to maintain downward drilling pressure and this downward force will not be sufficient to lift the machine into an unstable condition.

It is an object of the invention to inhibit an earth drilling machine from climbing its drill string when there is a high resistance to downward penetration.

It is another object of the invention to maintain a large downward drilling force when the control apparatus involved has functioned to cut-off further build-up of the downward force.

It is another object to provide a control for a drilling machine that senses a change in pressure in supporting jacks to cut-off a hydraulic downfeed motor and to entrap fluid within the motor to maintain a drilling pressure.

Other objects and advantages of the invention will become apparent from the description to follow. In the description reference is made to the accompanying drawings which form a part hereof and in which there is shown by way of illustration a preferred embodiment of the invention. Reference is made to the claims herein for interpreting the breadth of the invention.

DESCRIPTION OF A PREFERRED EMBODIMENT

Figure 1:
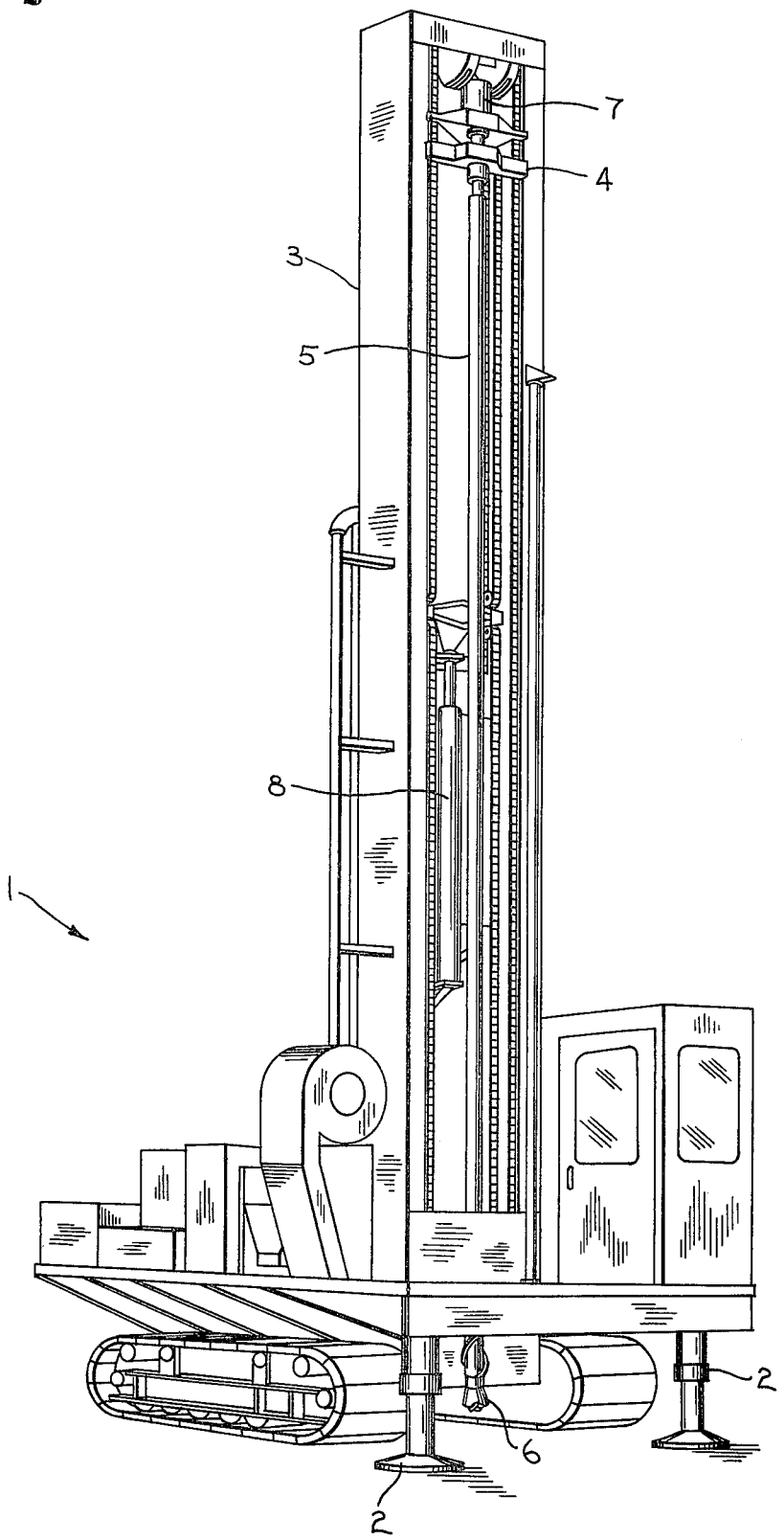
FIG. 1 is a view in perspective of a drilling machine with a mast in raised position and a pair of hydraulic jacks for supporting the machine.

Referring to FIG. 1 there is a drilling machine 1 which has been brought into position for drilling a hole in the earth. One end of the machine 1 has been raised on a pair of jacks 2 to level the machine and to support it in a stable position. A drill mast 3 adjacent the jacks 2 has been raised into its vertical position. The mast 3 supports a drilling head 4 that is moved downwardly and upwardly along the mast 3 to alternatively drive a drill string 5 with its drill bit 6 into the earth, or to raise the drill string 5 from the hole being drilled. The drilling head 4 comprises a frame which carries a rotary drilling motor 7 that imparts rotation to the drill string 5, and the head 4 is driven downward, or raised upwardly, in response to the actuation of a drill feed motor 8 located on the back side of the mast 3. The drill feed motor 8 shown in FIG. 1 comprises a linear motion, hydraulic cylinder, and through reeving that may be of conventional design its motion is multiplied and transmitted to the drill string 5.

Figure 2:
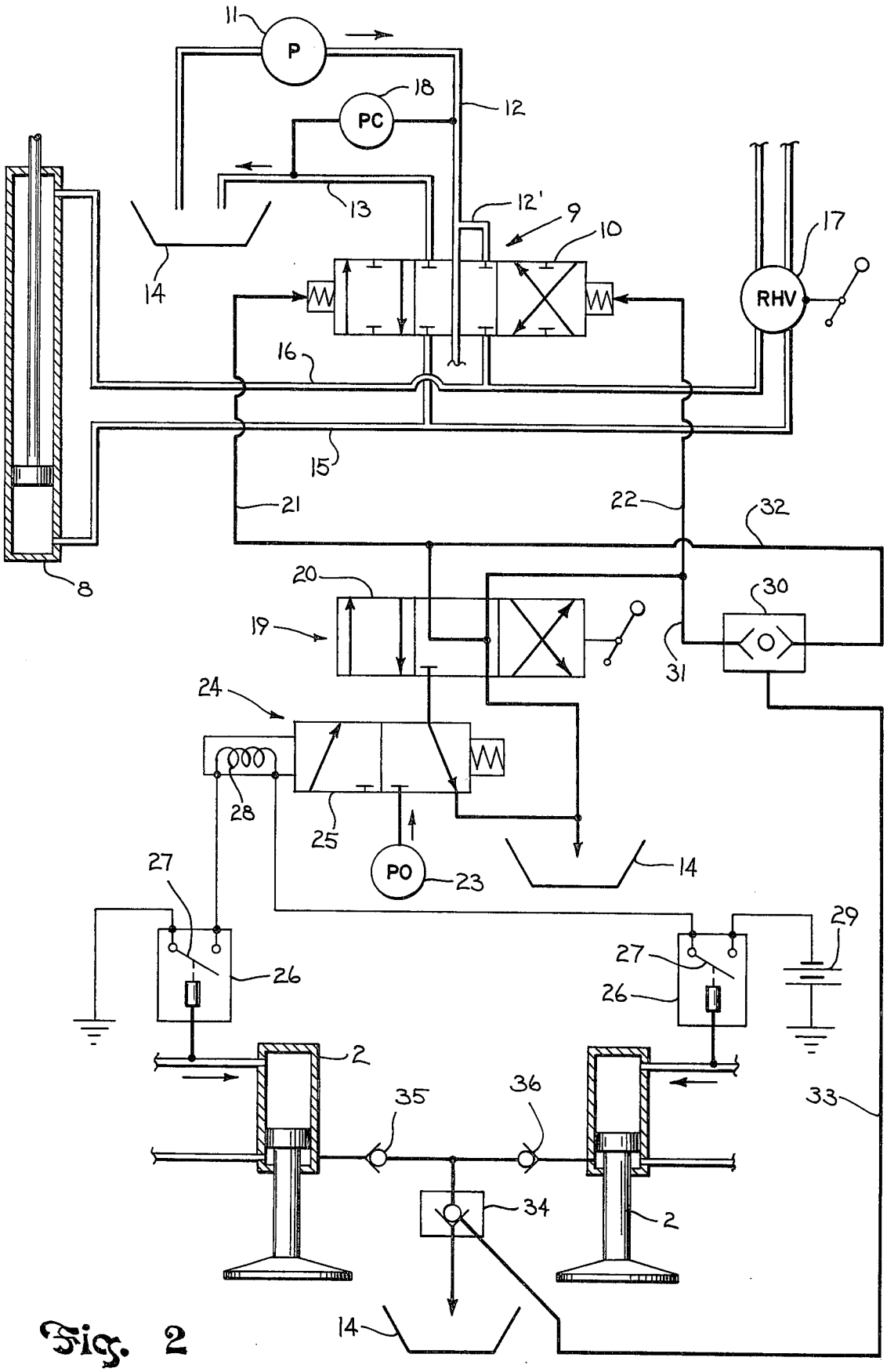
FIG. 2 is a schematic diagram of a control system for the drilling machine of FIG. 1. which embodies the invention.

The drill feed motor 8 is schematically shown at the upper left of FIG. 2, and has both head and rod ends to which pressurized hydraulic fluid may be delivered. To deliver fluid to the motor 8 there is a feed control valve 9 having an axially shiftable operating spool 10. The operating spool 10 is biased to a center or off position, and pressurized fluid from a pump 11 is delivered through a duct 12 to the valve 9. For the centered position, the duct 12 continues through and beyond the spool 10 to other control elements for the drilling machine, and it is shown as being broken off on the lower side of the spool 10 to indicate that it supplies pressurized fluid to apparatus in addition to that of the invention. A short branch duct 12' feeds off the duct 12 to present a second source of pressurized fluid to the valve spool 10, and it is through this branch duct 12' that pressurized fluid will be fed through the valve 9 to the feed motor 8. A fluid return duct 13 lead from the spool 10 to a reservoir 14.

On the outlet side of the spool 10 a first duct 15 connects to the head end of the drill feed motor 8, and a second duct 16 connects to the rod end of the drill feed motor 8. A manually operable rapid hoist valve 17 is also connected to the drill feed motor 8, by having its work ports communicating with the ducts 15 and 16. The inlet side of the rapid hoist valve 17 is connected to a separate pump (not shown), and it provides an operator with a control for rapidly raising and lowering the drill string 5. A rapid hoist system is a usual part of a drilling control mechanism, and as such is not a part of the present invention. When it is not being used, its connections with the motor 8 are blind, so that it has no affect upon the operation of the invention as described hereinafter.

There is also a feed pressure control 18 for the pressurized fluid supply that is joined between the duct 12 and the reservoir 14. It is manually controllable to select the pressure to be delivered through the duct 12 to the feed motor 8, and in this manner the drilling pressure in the hole being drilled may be varied to suit drilling conditions.

A control for the setting of the spool 10 of the main control valve 9 is provided by a direction selector valve 19. This valve 19 has a manually operated three position spool 20, and functions to direct pressurized pilot oil through its spool 20 to either one of the opposite ends of the main control valve spool 10 via the pilot oil lines 21 and 22. Pilot oil is fed to the spool 20 of the direction selector valve 19 from a pilot oil source 23. The source 23 is connected to the spool 20 through a solenoid operated directional control valve 24 which functions as an overload valve. The valve 24 has a spring biased spool 25 that is shown in FIG. 2 in its normal position in which flow of pilot oil from the source 23 is blocked. When the spool 20 of the direction selector valve 19 is in its center, or off position, as shown, the lines 21 and 22 are connected to the reservoir 14, so that there will be no pilot oil pressure in either of them. The spool 10 of the main control valve 9 will then assume its center position, as shown, in response to the bias springs at its opposite ends.

The lifting jacks 2 are shown at the lower left and right of FIG. 2. Pressurized fluid is fed into the head ends of the jacks 2 to raise the end of the drilling machine 1 off the ground for a firm, level support. After drilling is completed, and the machine 1 is to be moved to another position, the machine 1 is lowered and pressurized oil is admitted to the rod ends of the jacks 2 to raise the rods of the jacks 2 above the ground. A pressure switch 26 has its pressure duct connected in communication with the head end of each leveling jack 2, and is provided with normally open contacts 27 that are closed upon the pressure reaching a predetermined level. The contacts 27 are serially connected in an electrical circuit with an operating coil 28 of the solenoid valve 24 and a voltage supply 29, so that when the normally open contacts 27 are closed the solenoid valve coil 28 is energized to move the spool 25 to the right to connect the pilot oil source 23 with the input side of the selector valve spool 20.

The control apparatus described to this point functions in the following manner: with the drilling machine 1 raised on the jacks 2 the pressure within the jacks is at a high level indicative of the machine weight as measured at the drilling end, and the pressure switch contacts 27 are closed. The solenoid valve spool 25 is consequently moved into its right hand position. Pilot oil from the source 23 is therefore fed through the spool 25 up to the spool 20 of the direction selector valve 19. The operator may adjust the spool 20 for either raising or lowering the drill string 5, and assuming that drilling is to take place the spool 20 will be shifted to the left to feed pilot oil to the line 22. This shifts the spool 10 of the feed control valve 9 to the left, and pressurized operating fluid is then fed from the duct 12' to the duct 15 and into the head end of the drill feed motor 8. The rod end of the motor 8 is then connected through the line 16, the spool 10 and the duct 13 to the reservoir 14. Downfeed pressure is thus developed, as regulated by the setting of the feed pressure control 18, for driving the drill string 5 into the earth. With the drill string 5 and drill bit 6 being rotated by the rotatry drilling motor 7 drilling will occur.

If the resistance to drilling is such that penetration cannot be made into the earth, or if the drill string 5 becomes hung up in the hole being drilled so that it will not descend, so that the movement of the piston of the drill feed motor 8 is arrested, then the pressure within the head end of the motor 8 may rise. The resultant downfeed force can increase to a value exceeding the weight of the drilling machine 1. Since the drilling force reacts upwardly against the machine 1, the machine may be urged to climb the drill string 5, rather than the drill string 5 penetrating the earth, when the exerted force exceeds the weight of the machine. When such a condition occurs, the weight of the machine 1 is relieved from the jacks 2, and there will be a decrease of pressure within one or both of the head ends of the leveling jacks 2. For instance, the pressure may fall in the left hand jack 2, so that its associated switch contacts 27 are opened. This disconnects the solenoid valve coil 28, and allows the spring bias of the solenoid valve to shift the spool 25 to the position shown in FIG. 2. This, in turn, cuts off the supply of pilot oil pressure from the line 22. Also, the shift of the spool 25 will connect the line 22 through the spool 20 to the reservoir 14, so that pilot oil pressure is definitely lost in the line 22. The line 21 had already been connected to the reservoir 14 upon the shift of the spool 20 to the left, and therefore no pilot oil pressure will be delivered to the spool 10 of the main control valve 9. The spool 10 then shifts to its center position, as shown, in response to its spring bias. With he spool 10 in its center position, the head end of the drill feed motor 8 is cut off from the ducts 12 and 12', so that the head end of the drill feed motor 8 is isolated from both ducts 12 and 13. Since the rapid hoist valve 17 is not operated at this point in time the pressurized fluid in the head end of the drill feed motor 8 has no place to flow and becomes entrapped therein. To the extent the weight of the drilling machine 1 has been relieved from the jacks 2, its mass is borne by the motor 8. The motor 8 acts as a rigid member, because of the entrapped fluid, and transmits the force, or weight, of the machine 1 through the drill string 5 to the drill bit 6.

With the weight of the drilling machine 1 being applied to the drill bit 6 drilling pressure is maintained, even though the supply of pressurized fluid to the motor 8 has been totally cut-off. Drilling may then continue, with a safe downfeed force that cannot raise the machine 1 on the jacks 2. As penetration of the earth now occurs the machine 1 firmly settles upon the left hand jack 2, and the pressure in the jack 2 will rise to reclose the contact 27 of the associated pressure switch 26. Operation can now pick up as before the interruption of penetration. The operator, may, of course, intervene in the operation. For example, he can retract the drill string 5 upwardly by operation of the rapid hoist valve 17, or he can reset the feed pressure control 18 to a lower value. In any event when the drilling reaction force became excessive, so as to commence lifting the machine 1, there was an immediate sensing of the condition and a cutoff of hydraulic fluid to the downfeed motor 1.

For the circuit as described to this point, it is assumed the pressure in the rod ends of the lifting jacks 2 is very low, but in actual practice this may not be the case at all times, for some leakage may occur from the head end of the jacks 2 around the piston heads to the rod ends. It is therefore desirable to have some means of draining fluid that may accumulate in the lifting jack rod ends. For this purpose, a shuttle valve 30 is provided which has its two opposite ends connected through lines 31 and 32 to the lines 21 and 22 respectively. The center point of the shuttle valve 30 is connected through a fluid control line 33 to the pilot connection of a check valve 34. The input side of the check valve 34 is connected through a pair of check valves 35 and 36 to the rod ends of the lifting jacks 2, and the outlet side of the pilot operated check valve 34 leads to the reservoir 14.

When no pilot oil pressure is delivered to either of the lines 21 or 22 the shuttle valve 30 will be in its centered, or closed position, so that no oil is fed through the line 33 to the pilot operated check valve 34. However, whenever oil pressure is delivered to either of the pilot lines 21 or 22, the respective line 31 or 32 will transmit fluid pressure to the shuttle valve 30, and such pressure is then fed through the line 33 to the pilot operated check valve 34 to unseat it. This opens the check valve 34, to allow leakage oil to drain from the rod ends of either or both of the leveling jacks 2. The check valves 35 and 36 are provided to prohibit crossover of oil from one jack 2 to the other.

In FIG. 1, the machine 1 is shown with a pair of jacks 2 at the rear, or drilling end of the machine. There usually is a third jack at the front, or opposite end that is more distant from the drill hole. Such front jack is normally not affected to the same degree when an overload occurs on the drill string that may cause the machine 1 to rise. However, if desired, such additional jack could be included in the control system of the invention. The machine 1 can also be on a wheeled vehicle, rather than one with tread belts, and for purposes of mobility this could be preferred, although this is not a part of the invention.

There has thus been described a control system for a drilling machine that will inhibit drilling pressure from rising to the point that the drilling machine will lift itself from a seated position on its supporting jacks. This is accomplished by sensing hydraulic pressure in the jacks, which will fall sharply in value as the machine tends to rise. As soon as this tendency to rise occurs there will be an immediate pressure decrease in the jacks that triggers the system to operate before a dangerous rise of the machine occurs.

I claim:

1. In a tilt control for a drilling machine having hydraulic supporting jacks for the machine, a hydraulic drill feed motor, and a source of pressurized fluid, the combination comprising:

(a) a feed control valve between said source of pressurized fluid and said drill feed motor having one position for admitting fluid to said drill feed motor, and having a second position for isolating said drill feed motor from said fluid source with fluid entrapped within the motor;

(b) a control circuit for said feed control valve that sets the valve in a selected one of its positions, and (c) pressure responsive means in pressure sensing connection with said hydraulic jacks that is joined in said control circuit to shift said feed control valve to its second position in response to a pressure change within said hydraulic jacks.

2. In a tilt control for a drilling machine having hydraulic supporting jacks for the machine, a hydraulic drill feed motor, and a source of pressurized fluid, the combination comprising:

(a) a feed control valve between said source of pressurized fluid and said drill feed motor for admitting fluid to said drill feed motor and for isolating said drill feed motor from said fluid source;

(b) a direction selector valve for admitting pilot oil to said feed control vavle;

(c) an overload valve joined with said direction selector valve and having a position to relieve pilot oil pressure;

(d) pressure responsive switch means in pressure sensing connection with said hydraulic jacks and having a control circuit connected with said overload valve to shift the same to its pilot oil relieving position in response to pressure change within said hydraulic jacks.

3. A tilt control as in claim 2 having drain lines leading from the ends of said hydraulic jacks opposite that which hold supporting fluid; a pilot operated valve in said lines; and connections for feeding pilot oil to said pilot operated valve upon admission of pilot oil to said feed control valve.

4. A tilt control as in claim 2 having a rapid hoist control valve between said source of pressurized fluid and said drill feed motor that is in shunting relation to said feed control valve.

5. In a drilling control for the downfeed of an earth drilling machine having hydraulic jacks for supporting the machine, a hydraulic downfeed motor, and a source of pressurized fluid, the combination comprising:

(a) a main control valve connected to said downfeed motor having alternative valve positions for:

(i) feeding pressurized fluid to said motor to establish a downfeed pressure, and (ii) isolating said downfeed motor from such pressurized fluid with fluid entrapped in the motor;

(b) a hydraulic circuit for pilot fluid having:

(i) connections applying pilot fluid to said main control valve for operating the same between said alternative valve positions, (ii) a direction selection valve having alternate positions for applying pilot fluid to said main control valve to cause a corresponding shift between the alternative positions of such main control valve; and (iii) a solenoid valve that drains the pilot fluid circuit upon actuation thereof; and (c) a pressure responsive switch hydraulically connected to a hydraulic jack and in electrical circuit with said solenoid valve having contacts responsive to pressure for operation of said solenoid valve.

* * * * *